US010119746B2

(12) United States Patent
Maruyama et al.

(10) Patent No.: US 10,119,746 B2
(45) Date of Patent: Nov. 6, 2018

(54) INDOOR UNIT AND AIR-CONDITIONING APPARATUS

(71) Applicant: Mitsubishi Electric Corporation, Tokyo (JP)

(72) Inventors: Masaaki Maruyama, Tokyo (JP); Takaaki Takishita, Tokyo (JP); Akinori Toyoda, Tokyo (JP); Tatsuo Furuta, Tokyo (JP); Hiroyuki Hatakeyama, Tokyo (JP); Naoya Matsunaga, Tokyo (JP); Takahiro Komatsu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/027,287

(22) PCT Filed: Oct. 9, 2014

(86) PCT No.: PCT/JP2014/077116
§ 371 (c)(1),
(2) Date: Apr. 5, 2016

(87) PCT Pub. No.: WO2015/098238
PCT Pub. Date: Jul. 2, 2015

(65) Prior Publication Data

US 2016/0245578 A1 Aug. 25, 2016

(30) Foreign Application Priority Data

Dec. 25, 2013 (JP) ..... 2013-267604

(51) Int. Cl.
*F25D 21/14* (2006.01)
*F24F 13/20* (2006.01)
(Continued)

(52) U.S. Cl.
CPC ..... *F25D 21/14* (2013.01); *F24F 13/20* (2013.01); *F24F 13/22* (2013.01); *F24F 13/222* (2013.01);
(Continued)

(58) Field of Classification Search
CPC ..... F25D 21/14; F25D 2321/147; F25D 2321/144; F25D 2321/143;
(Continued)

(56) References Cited

U.S. PATENT DOCUMENTS 5,577,779 A * 11/1996 Dangel ..... E05C 19/06 220/326
8,025,172 B1 * 9/2011 Zink ..... E04H 4/14 220/485

FOREIGN PATENT DOCUMENTS

JP 2006-194494 A 7/2006
JP 2007-205668 A 8/2007
(Continued)

OTHER PUBLICATIONS

English Machine Translation of JP 2013-79790, Yamato.*
(Continued)

*Primary Examiner* — David Teitelbaum
(74) *Attorney, Agent, or Firm* — Posz Law Group, PLC

(57) ABSTRACT

An indoor unit according to the present invention includes a securing plate provided at an upper edge of a sidewall of a drain pan that collects drain water generated from an indoor heat exchanger, and an antimicrobial-agent-containing case that contains an antimicrobial agent and includes a case frame positioned in an area where the drain water is collected, a case-attaching portion conforming to the securing plate and being detachably attached to the securing plate, and an arm connecting the case frame and the case-attaching portion. The antimicrobial-agent-containing case is attached
(Continued)

to the securing plate from an opening of an air inlet from which air is taken into a body.

3 Claims, 8 Drawing Sheets

(51) Int. Cl.
*F24F 13/22* (2006.01)
*F24F 6/00* (2006.01)

(52) U.S. Cl.
CPC ... *F24F 2006/006* (2013.01); *F24F 2013/228* (2013.01)

(58) Field of Classification Search
CPC .. F25D 2321/1442; B65D 81/264; F24F 3/16; F24F 2006/006; F24F 21/36; F24F 2321/147; F24F 2321/144; F24F 2321/143; F24F 2321/1442; F24F 1/36; Y10T 24/44026
USPC ..... 220/571; 62/78
See application file for complete search history.

(56) References Cited

FOREIGN PATENT DOCUMENTS

| | | |
|---|---|---|
| JP | 2010-065931 A | 3/2010 |
| JP | 2013-079790 A | 5/2013 |

OTHER PUBLICATIONS

Australian Office Action dated Oct. 5, 2016 in the corresponding AU application No. 2014371784.
International Search Report of the International Searching Authority dated Jan. 6, 2015 for the corresponding international application No. PCT/JP2014/077116 (and English translation).
Office Action dated Jan. 5, 2017 in the corresponding CN patent application No. 201410798396.9 (with English translation).
Japanese Office Action dated Jun. 28, 2016 in the corresponding JP application No. 2013-267604. (English translation attached).
Extended European Search Report dated Sep. 5, 2017 issued in corresponding EP patent application No. 14875214.0.

* cited by examiner

INDOOR UNIT AND AIR-CONDITIONING APPARATUS

CROSS REFERENCE TO RELATED APPLICATIONS

This application is a U.S. national stage application of PCT/JP2014/077116 filed on Oct. 9, 2014, which claims priority to Japanese patent application No. 2013-267604 filed on Dec. 25, 2013, the contents of which are incorporated herein by reference.

TECHNICAL FIELD

The present invention relates to an indoor unit or any other like unit included in an air-conditioning apparatus or any other like apparatus and, in particular, to a structure of attaching an antimicrobial agent.

BACKGROUND ART

Indoor units (such as four-way cassette air-conditioning units) provided on the indoor side of known air-conditioning apparatuses or other like apparatuses include indoor heat exchangers and air-sending devices. The indoor heat exchangers are each provided therebelow with a drain pan that receives drain water condensed on the heat exchanger. The drain water received by the drain pan is discharged to the outside of the indoor unit through a drain pump and a drain pipe. In such a configuration, substances such as germs and mold in the air tend to fall into the drain water and to propagate therein. When germs and mold propagate, slime may be generated in the drain pan. The slime may lead to defective drainage such as generation of odor or clogging of the drain pipe. Hence, some indoor units include containers provided in the drain pans. The containers each contain an antimicrobial agent that suppresses the propagation of substances such as germs and mold. Since components of the antimicrobial agent in the container are dissolved into the drain water, an antimicrobial characteristic is imparted to the wet area. Thus, the propagation of substances such as germs and mold is suppressed (see Patent Literature 1, for example).

CITATION LIST

Patent Literature

Patent Literature 1: Japanese Unexamined Patent Application Publication No. 2006-194494 (FIGS. 1 to 3)

SUMMARY OF INVENTION

Technical Problem

When a worker performs maintenance work or any other like kind of work on such a known indoor unit, an antimicrobial-agent-containing kit is attached to a position in the drain pan after, for example, the drain pan and/or other associated members provided in the body of the indoor unit are removed. In such a case, the kit needs to be attached or detached by reaching out a hand up to the position where the drain pan is provided. Therefore, some problems for the worker arise, such as difficulty in visually checking the inside through an opening and through a space around the hand, and a troublesome situation in identifying the attaching position in a dim space in a bell-mouth.

The present invention is to solve the above problems and provides an indoor unit or any other like unit in which an antimicrobial-agent-containing case is easily attachable to and detachable from a drain pan.

Solution to Problem

An indoor unit according to the present invention includes a securing plate provided at an upper edge of a sidewall of a drain pan that collects drain water generated from a heat exchanger and an antimicrobial-agent-containing case that contains an antimicrobial agent and includes a container portion positioned in an area where the drain water is collected, a case-attaching portion conforming to the securing plate and being detachably attached to the securing plate, and an arm connecting the container portion and the case-attaching portion, the antimicrobial-agent-containing case being attached to the securing plate from an opening of an air inlet from which air is taken into a body.

Advantageous Effects of Invention

In the indoor unit according to the present invention, the securing plate is provided at the upper edge of the sidewall of the drain pan. Furthermore, the antimicrobial-agent-containing case that includes the case-attaching portion detachably attached to the securing plate, the container portion containing the antimicrobial agent, and the arm is attached to the securing plate from the opening of the air inlet. Thus, an indoor unit to which an antimicrobial-agent-containing case is easily and properly attachable and detachable is provided.

DESCRIPTION OF EMBODIMENTS

Figure 1:
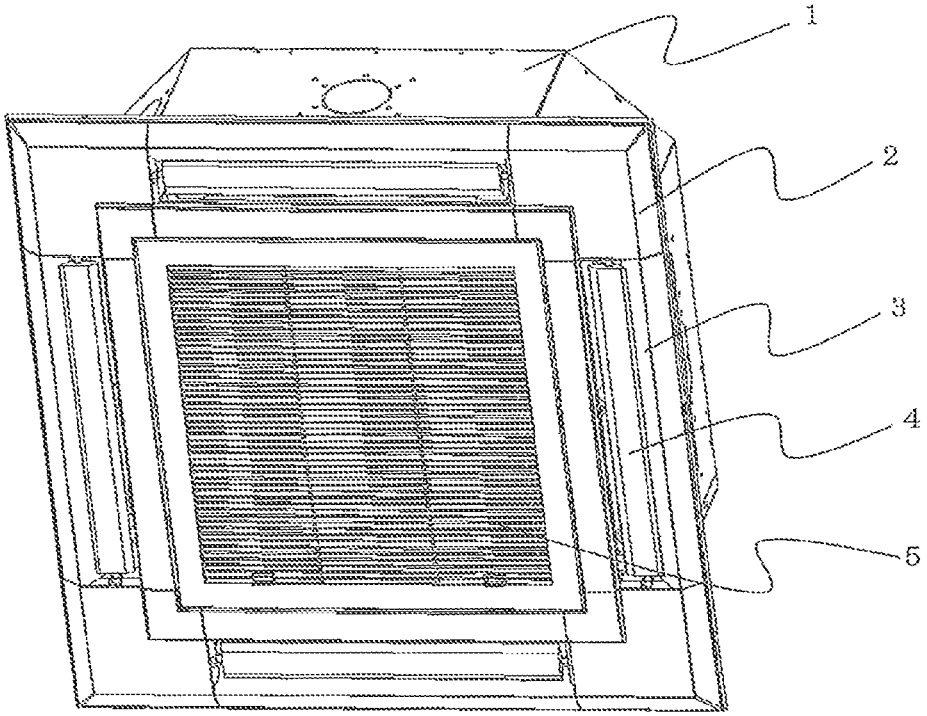
FIG. 1 is a diagram illustrating an appearance of an indoor unit 100 according to Embodiment 1 of the present invention.

Indoor units and other like units according to embodiments of the present invention will now be described with reference to the drawings and other associated materials. In the drawings to be referred to below, like reference numerals denote like or corresponding elements, which applies to the entirety of the following embodiments. Furthermore, modes of the elements described throughout the specification are only exemplary and are not limited thereto. Particularly, a combination of elements does not necessarily be made within a single embodiment. An element described in one embodiment may also be applied to another embodiment. In each of the drawings, the top side is referred to as "upper side" and the bottom side is referred to as "lower side." The elements in the drawings are not necessarily illustrated to scale.

Embodiment 1

FIG. 1 is a diagram illustrating an appearance of an indoor unit 100 according to Embodiment 1 of the present invention. The indoor unit 100 described in Embodiment 1 is a typical indoor unit of a ceiling-concealed four-way cassette type that is installable in the ceiling of an indoor space and has air outlets on four sides thereof. The indoor unit 100 is connected to an outdoor unit 200 to be described later, whereby refrigerant circuit that performs an operation such as refrigeration or air-conditioning by allowing refrigerant to circulate therethrough is provided. A body 1 of the indoor unit 100 includes, for example, indoor heat exchanger 110, a turbo fan 6, and a drain pan 7, which are to be described later, and a motor for driving an air-sending device, a bell-mouth, and other associated elements, which are not illustrated.

Furthermore, the body 1 is provided with a decorative panel 2 as an exterior panel of the indoor unit. The decorative panel 2 is provided at the bottom of the body 1 and on the indoor side. The decorative panel 2 includes an intake grille 5 in a central part thereof. The intake grille 5 provides an air inlet from which indoor air is taken into the body 1. Air outlets 3 provided with respective wind-direction-adjusting vanes 4 are provided on the respective outer sides of the intake grille 5.

Figure 2:
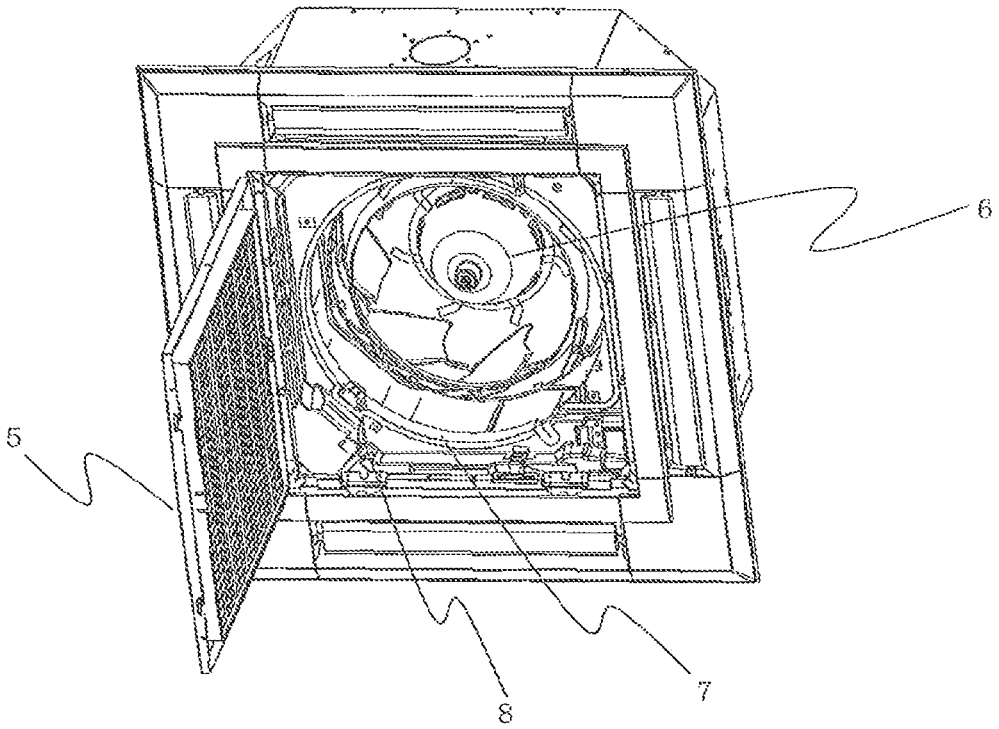
FIG. 2 is a perspective internal-configurational view of the indoor unit 100 according to Embodiment 1 of the present invention and illustrates an internal configuration thereof seen from the bottom.

FIG. 2 is a perspective internal-configurational view of the indoor unit 100 according to Embodiment 1 of the present invention and illustrates an internal configuration thereof seen from the bottom. In FIG. 2, the intake grille 5 at the center of the decorative panel 2 is opened, so that the internal configuration can be seen. For easy viewing of relevant elements, the bell-mouth, which is one of the elements provided in the body, is removed in FIG. 2. The bell-mouth guides the air taken into the turbo fan 6. Note that the bell-mouth is removed when the worker performs any work.

The body 1 includes the turbo fan 6, which is an air-sending device. The drain pan 7 collects drain water generated from the heat exchanger that is provided in such a manner as to surround the turbo fan 6. The drain pan 7 according to Embodiment 1 includes a drain-pan case-attaching portion 8 provided on the inner side (a side on which the drain water is collected) thereof such that, if any drain water is collected in the drain pan 7, an antimicrobial agent 24 is immersed in the drain water as to be described later.

Figure 3:
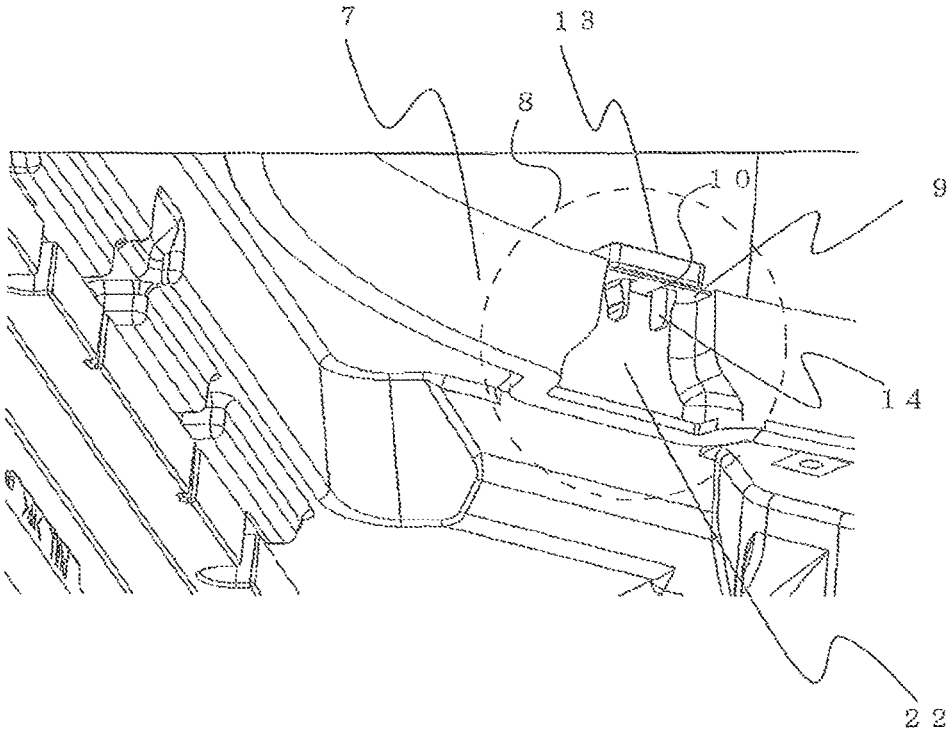
FIG. 3 is an enlarged view of featured elements including a drain-pan case-attaching portion 8 and peripheral elements included in the indoor unit 100 according to Embodiment 1 of the present invention.

FIG. 3 is an enlarged view of featured elements including the drain-pan case-attaching portion 8 and peripheral elements included in the indoor unit 100 according to Embodiment 1 of the present invention. FIG. 3 illustrates a state where an antimicrobial-agent-containing case 11, to be described later, is attached to the drain pan 7 that is seen from an air-inlet side (the outer side of the drain pan 7). The drain pan 7 includes a securing plate 9 provided at the drain-pan case-attaching portion 8. The securing plate 9 is formed by, for example, insert molding. The securing plate 9 is a metal plate and has durability to withstand any work or other like situations. The securing plate 9 has attaching holes 10. Elastic tab portions 14 of a case-attaching portion 13 included in the antimicrobial-agent-containing case 11 are inserted into the respective attaching holes 10. The antimicrobial-agent-containing case 11 is securely held at a predetermined position of the drain pan 7 while being locked by the tab portions 14 extending through the attaching holes 10.

The drain pan 7 has an attaching space 22 provided below the securing plate 9. The attaching space 22 facilitates the insertion and removal of the antimicrobial-agent-containing case 11 to and from the attaching holes 10 of the securing plate 9. Therefore, for example, the worker can remove the antimicrobial-agent-containing case 11 by putting some fingers into the attaching space 22 and pinching the tab portions 14 with the fingers. Since the attaching space 22 is provided, the tab portions 14 are visible if the antimicrobial-agent-containing case 11 is attached to the drain pan 7. Hence, the state of attaching can be readily checked.

Figure 4:
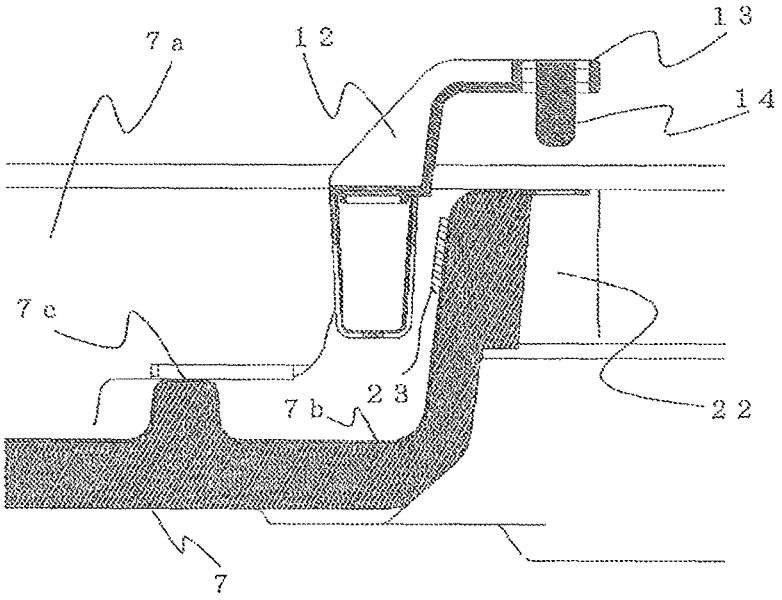
FIG. 4 is a sectional view (part 1) of the featured elements including the drain-pan case-attaching portion 8 and peripheral elements included in the indoor unit 100 according to Embodiment 1 of the present invention.
Figure 5:
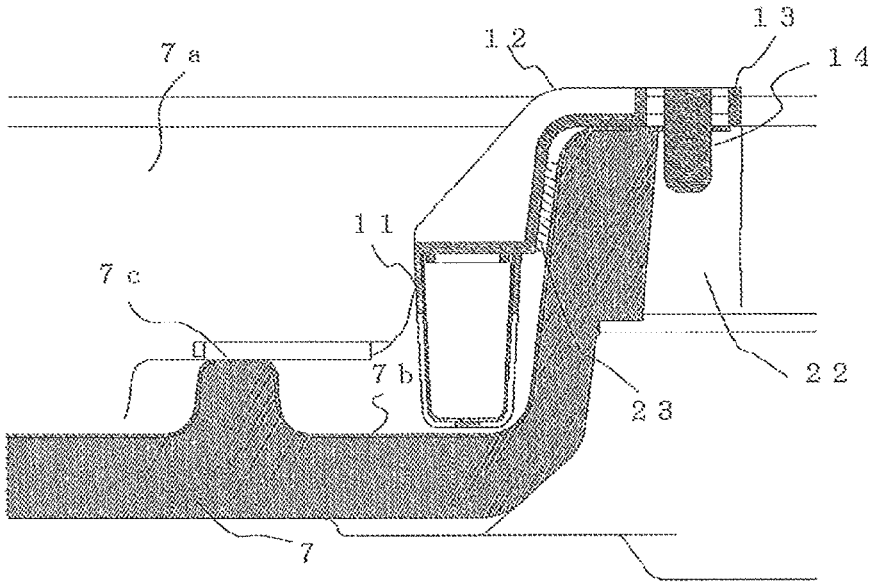
FIG. 5 is a sectional view (part 2) of the featured elements including the drain-pan case-attaching portion 8 and peripheral elements included in the indoor unit 100 according to Embodiment 1 of the present invention.

FIGS. 4 and 5 are sectional views of the featured elements including the drain-pan case-attaching portion 8 and peripheral elements included in the indoor unit 100 according to Embodiment 1 of the present invention. FIG. 4 illustrates a state where the antimicrobial-agent-containing case 11 is yet to be attached. FIG. 5 illustrates a state where the antimicrobial-agent-containing case 11 has been attached. As illustrated in FIG. 4, the antimicrobial-agent-containing case 11 is attached to the drain pan 7 from the upper side. In the state illustrated in FIG. 5 where the antimicrobial-agent-containing case 11 (the case-attaching portion 13) has been attached to the drain pan 7 (the securing plate 9), the antimicrobial-agent-containing case 11 (a container portion) is securely held with the bottom thereof being at a predetermined distance from the bottom of the drain pan 7.

A drain-pan wall **7*a* is a wall of the drain pan 7. A drain-water-collecting portion 7*b* is a portion provided at the bottom of the drain pan 7 and where the drain water is collected (flows down). A heat-exchanger-mounting stand 7*c* is a portion serving as a stand on which the indoor heat exchanger 110 is mounted. The heat-exchanger-mounting stand 7*c* is provided in an approximately middle part of the drain pan 7. That is, the drain pan 7 extends over a primary side and a secondary side of the indoor heat exchanger 110. A cushion 23 reduces the force of the impact that may occur between an arm 12 and the drain pan 7 when the antimicrobial-agent-containing case 11** is attached, and thus suppresses the rubbing of the two against each other.

Figure 6:
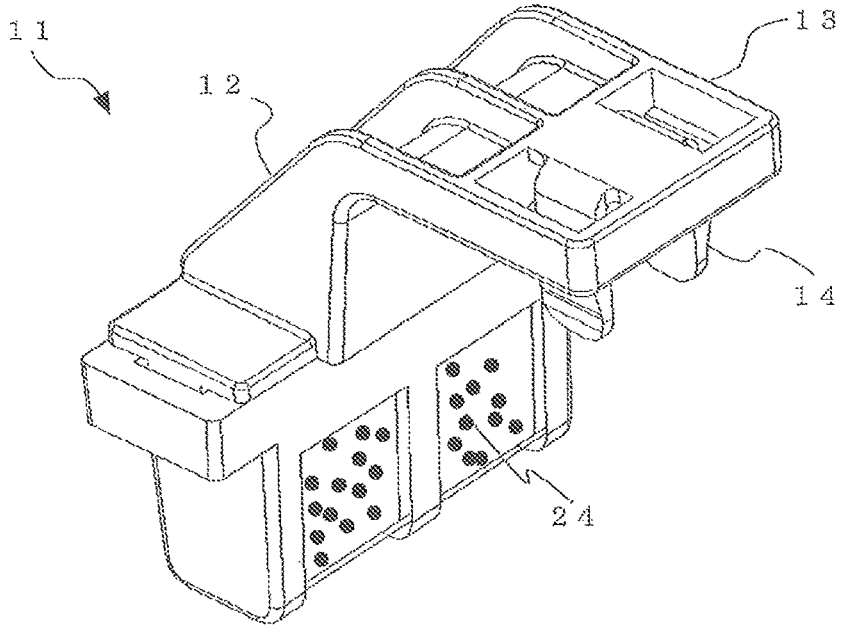
FIG. 6 is a diagram illustrating an appearance of an antimicrobial-agent-containing case 11 according to Embodiment 1 of the present invention.

FIG. 6 is a diagram illustrating an appearance of the antimicrobial-agent-containing case 11 according to Embodiment 1 of the present invention. As illustrated in FIG. 6, the antimicrobial-agent-containing case 11 contains (confines) the below-described antimicrobial agent 24 that prevents the propagation of substances such as germs in the drain water and other like phenomena. The antimicrobial agent 24 suppresses the generation of slime or other like substances that may be generated in the drain water because of the propagation of germs and mold in the air, and thus prevents the occurrence of problems such as defective drainage such as the generation of odor, the clogging of a drain pipe, or any other like incident.

The antimicrobial-agent-containing case 11 includes the arm 12, the case-attaching portion 13, and the tab portions 14 that are positioned above the container portion thereof in which the antimicrobial agent 24 is contained. As described above, the case-attaching portion 13 is attached to the securing plate 9 with the aid of the tab portions 14. The securing plate 9 is positioned on the upper part of the sidewall of the drain pan 7. Thus, the case-attaching portion 13 retains the antimicrobial-agent-containing case 11. On the other hand, the container portion of the antimicrobial-agent-containing case 11 in which the antimicrobial agent 24 is contained needs to be positioned at a predetermined distance from the bottom of the drain pan 7. Hence, the arm 12 serves as a bridge that connects the case-attaching portion 13 and the container portion to each other. The arm 12 has a shape conforming to the shape of the sidewall of the drain pan 7 on the side of the air-sending device (the turbo fan 6). Therefore, the container portion can be brought into close contact with the sidewall of the drain pan 7. Furthermore, since the shape of a combination of the arm 12 and the case-attaching portion 13 tends to fit in the palm, the worker can easily perform attaching work and other like kinds of work.

Figure 7:
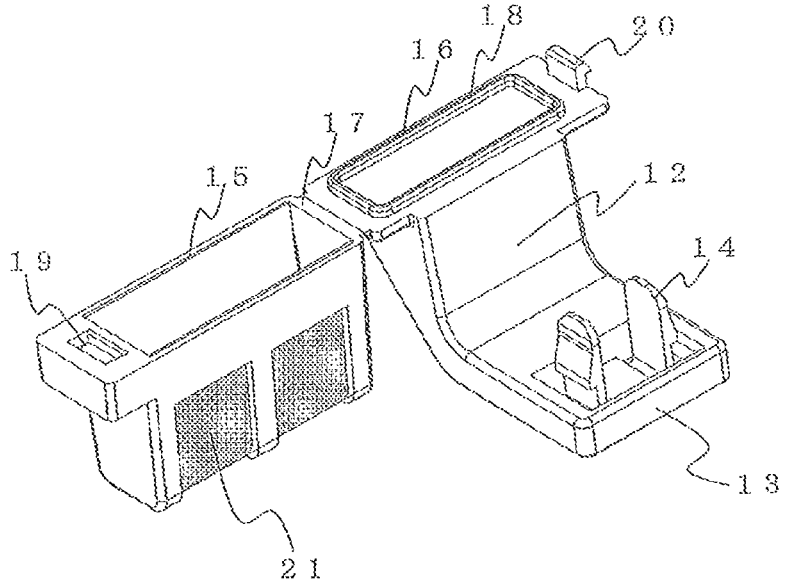
FIG. 7 is a diagram (part 1) illustrating a structure of the antimicrobial-agent-containing case 11 according to Embodiment 1 of the present invention.
Figure 8:
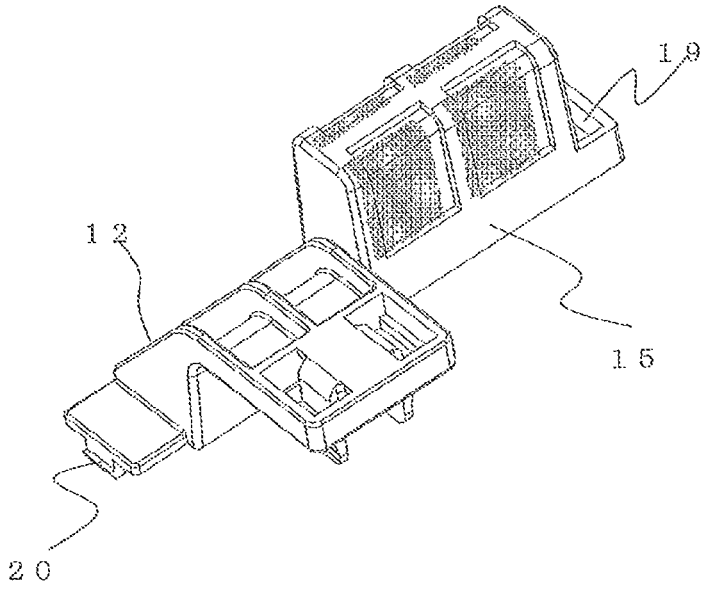
FIG. 8 is a diagram (part 2) illustrating the structure of the antimicrobial-agent-containing case 11 according to Embodiment 1 of the present invention.

FIGS. 7 and 8 are diagrams illustrating the structure of the antimicrobial-agent-containing case 11 according to Embodiment 1 of the present invention. FIG. 7 is a diagram illustrating a state where a case lid 16 is removed. FIG. 8 is a bottom perspective view of the antimicrobial-agent-containing case 11 that is seen from the bottom. The antimicrobial-agent-containing case 11 is a resin-made case formed as an integral body including a case frame 15 serving as the container portion that contains the antimicrobial agent 24, the case lid 16, the arm 12, the case-attaching portion 13, and the tab portions 14. Hence, when the antimicrobial-agent-containing case 11 is folded at a hinge 17 that connects the case frame 15 and the case lid 16 to each other, the case frame 15 is covered by the case lid 16. In Embodiment 1, the case frame 15 has a case hole 19, and the case lid 16 has a case latch 20. When the case hole 19 and the case latch 20 are made to engage with each other, the case frame 15 is kept closed by the case lid 16. While Embodiment 1 describes a case where the above elements including the case frame 15 and the case lid 16 are formed as an integral body, the present invention is not limited to such a case. For example, the case frame 15 and the case lid 16 may be separate from each other.

The case lid 16 has a rib 18, whereby the antimicrobial agent 24 in the case frame 15 is prevented from leaking out. The case frame 15 is provided with a net 21 spreading over the periphery of the portion in which the antimicrobial agent 24 is contained. Components of the antimicrobial agent 24 are dissolved into the drain water through the net 21.

Figure 9:
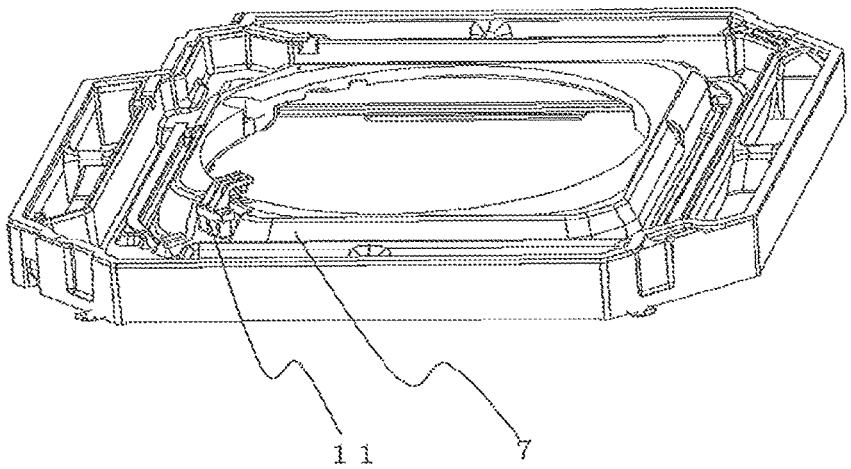
FIG. 9 is a perspective view of a drain pan 7 of the indoor unit 100 according to Embodiment 1 of the present invention.

FIG. 9 is a perspective view of the drain pan 7 of the indoor unit 100 according to Embodiment 1 of the present invention. In Embodiment 1, the antimicrobial-agent-containing case 11 is attached to a corner of the indoor unit 100. A drain pipe (not illustrated) through which the drain water is discharged to the outside of the indoor unit 100 is connected to the corner, where, for example, a drain pump 26 to be described later is attached.

Figure 10:
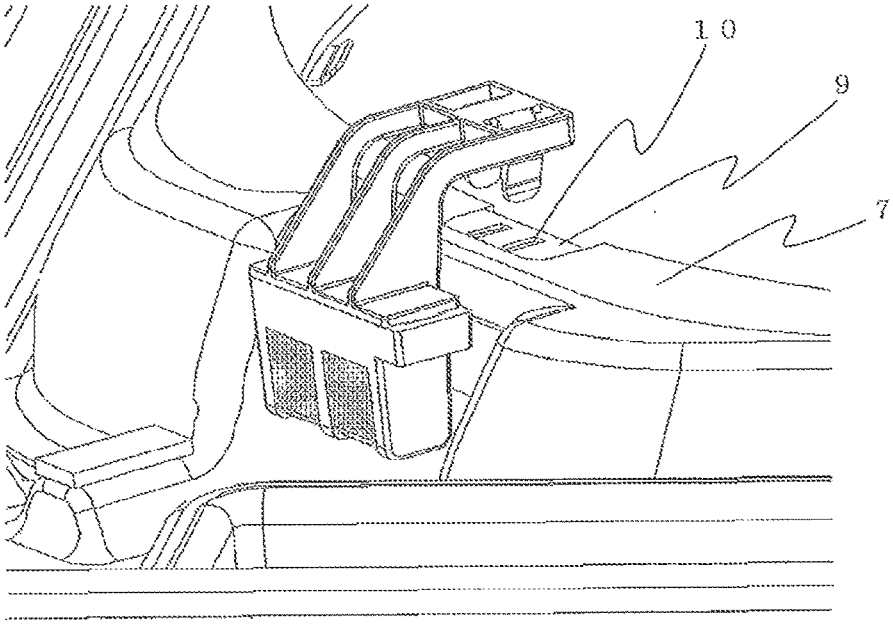
FIG. 10 is a diagram illustrating how the antimicrobial-agent-containing case 11 is attached to the drain pan 7 in Embodiment 1 of the present invention.

FIG. 10 is a diagram illustrating how the antimicrobial-agent-containing case 11 is attached to the drain pan 7 in Embodiment 1 of the present invention. For example, when the worker opens the intake grille 5 of the indoor unit 100 and removes the bell-mouth, a work space is provided above the drain pan 7 when the indoor unit 100 is seen from the air-inlet side. Utilizing the space, as described above, the worker attaches the antimicrobial-agent-containing case 11 from the upper edge of the inlet-side sidewall of the drain pan 7 such that the container portion including the case frame 15 that contains the antimicrobial agent 24 and the arm 12 are positioned in the drain-water-collecting portion 7*b*. In this state, the antimicrobial-agent-containing case 11 hangs on the drain pan 7. If the antimicrobial-agent-containing case 11 simply hangs on the drain pan 7, the antimicrobial-agent-containing case 11 is unstable. Therefore, the tab portions 14 are inserted into the attaching holes 10 of the securing plate 9. Thus, the antimicrobial-agent-containing case 11 is secured.

Figure 11:
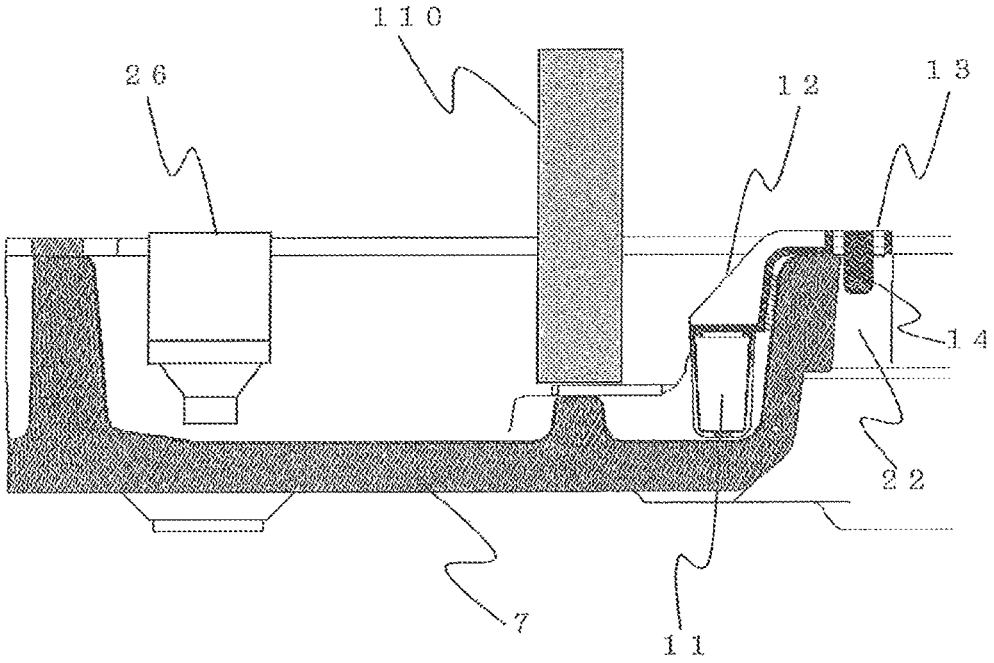
FIG. 11 is a sectional view of the featured elements including the drain-pan case-attaching portion 8 provided at the corner of the drain pan 7 of the indoor unit 100 according to Embodiment 1 of the present invention.

FIG. 11 is a sectional view of the featured elements including the drain-pan case-attaching portion 8 provided at the corner of the drain pan 7 of the indoor unit 100 according to Embodiment 1 of the present invention. The drain pump 26 produces a flow of drain water that causes the drain water collected on the drain pan 7 to flow into the drain pipe. To prevent the above-mentioned clogging of elements such as the drain pipe and the drain pump 26 due to slime or any other like substance, the antimicrobial-agent-containing case 11 is attached to a position close to the drain pump 26 and other associated elements.

As described above, in the indoor unit 100 according to Embodiment 1, the drain pan 7 is provided with the securing plate 9, and the antimicrobial-agent-containing case 11 including the arm 12, the case-attaching portion 13, and other elements can be attached from above the edge of the drain pan 7 on the side of the air-sending device that corresponds to the primary side (the inlet side) of the heat exchanger. Therefore, the worker does not need to remove the drain pan 7 and can perform attaching or removing work while visually checking the positional relationship between the antimicrobial-agent-containing case 11 and the drain pan 7 (the securing plate 9) from the air inlet having a wide opening. Accordingly, the worker can perform the above work easily and properly. Furthermore, the securing plate 9 has the attaching holes 10, and the tab portions 14 provided on the case-attaching portion 13 of the antimicrobial-agent-containing case 11 are inserted into the attaching holes 10, so that the antimicrobial-agent-containing case 11 is locked. Therefore, the antimicrobial-agent-containing case 11 can be readily secured.

Furthermore, the attaching space 22 is provided below the securing plate 9. Therefore, for example, the worker can easily handle the tab portions 14 in removing the antimicrobial-agent-containing case 11. Furthermore, whether or not the tab portions 14 are present can be visually checked. Therefore, whether or not the antimicrobial-agent-containing case 11 has been attached can be readily checked.

Furthermore, the antimicrobial-agent-containing case 11 is formed as an integral body including the case frame 15, the case lid 16, the arm 12, the case-attaching portion 13, the tab portions 14, and other associated elements. Therefore, the antimicrobial-agent-containing case 11 can be readily manufactured.

Embodiment 2

While Embodiment 1 describes a case where the attaching holes 10 of the securing plate 9 and the tab portions 14 of the case-attaching portion 13 are employed for attaching the antimicrobial-agent-containing case 11 to the securing plate 9, the present invention is not limited to such a case. The antimicrobial-agent-containing case 11 may be attached (fixed) to the securing plate 9 with any other thing such as an adhesive agent or a magnet.

Embodiment 3

Figure 12:
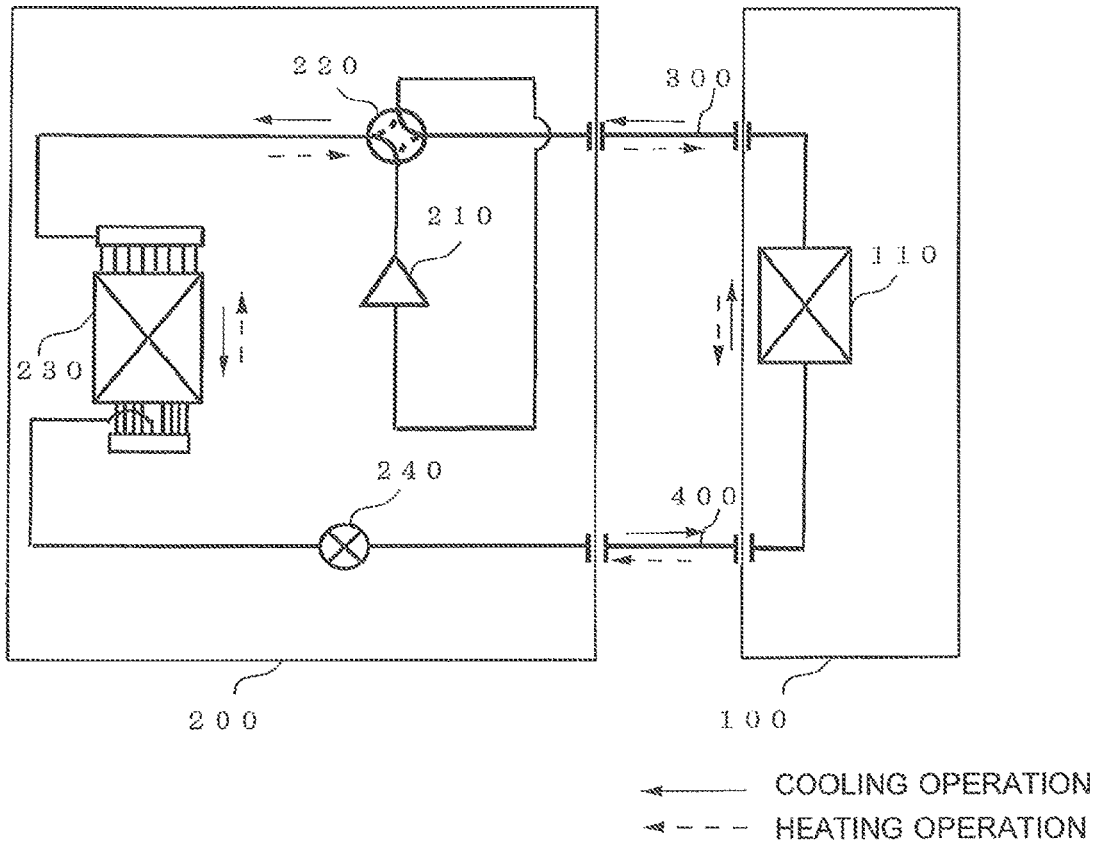
FIG. 12 is a diagram illustrating an exemplary configuration of an air-conditioning apparatus according to Embodiment 3 of the present invention.

FIG. 12 is a diagram illustrating an exemplary configuration of an air-conditioning apparatus according to Embodiment 3 of the present invention. The air-conditioning apparatus illustrated in FIG. 12 is an exemplary refrigeration-cycle apparatus. Elements illustrated in FIG. 12 and that have also been described with reference to FIG. 1 and others operate as already described above. In the air-conditioning apparatus illustrated in FIG. 12, the outdoor unit 200 and the indoor unit 100, which has been described in Embodiment 1, are connected to each other by a gas-refrigerant pipe 300 and a liquid-refrigerant pipe 400. The outdoor unit 200 includes a compressor 210, a four-way valve 220, an outdoor heat exchanger 230, and an expansion valve 240.

The compressor 210 compresses refrigerant taken thereinto and discharges the refrigerant. Note that the capacity (the amount of refrigerant to be discharged per unit time) of the compressor 210 may be, but is not limited to be, changeable by arbitrarily changing the operating frequency by using a device such as an inverter circuit. The four-way valve 220 is a valve that switches the flow of the refrigerant between, for example, that for a cooling operation and that for a heating operation.

The outdoor heat exchanger 230 according to Embodiment 3 allows the refrigerant and the air (outdoor air) to exchange heat with each other. For example, in the heating operation, the outdoor heat exchanger 230 functions as an evaporator and evaporates and gasifies the refrigerant. Furthermore, in the cooling operation, the outdoor heat exchanger 230 functions as a condenser and condenses and liquefies the refrigerant.

The expansion valve 240 such as an expansion device (flow-rate-controlling device) expands the refrigerant by reducing the pressure of the refrigerant. For example, if the expansion valve 240 is an electronic expansion valve, the expansion valve 240 controls the opening degree thereof in accordance with an instruction from a controller (not illustrated) or any other like device. The indoor heat exchanger 110 allows, for example, the air to be conditioned and the refrigerant to exchange heat with each other. In the heating operation, the indoor heat exchanger 110 functions as a condenser and condenses and liquefies the refrigerant. In the cooling operation, the indoor heat exchanger 110 functions as an evaporator and evaporates and gasifies the refrigerant.

In the air-conditioning apparatus configured as described above, the flow of the refrigerant is switched by the four-way valve 220 of the outdoor unit 200, whereby the heating operation and the cooling operation are both performable.

INDUSTRIAL APPLICABILITY

While each of Embodiments 1 to 3 describes a case where the indoor unit 100 is a four-way cassette indoor unit that has four air outlets and blows air in four directions, the present invention is not limited to such a case. For example, the present invention is also applicable to any other ceiling-concealed indoor unit that produces airflows in two or three directions. Moreover, the present invention is applicable to indoor units of any other types, as well as the ceiling-concealed type.

While Embodiment 3 describes a case where the air-conditioning apparatus is an exemplary refrigeration-cycle apparatus, the present invention is not limited to such a case. For example, the present invention is also applicable to any other refrigeration-cycle apparatuses such as a cooling apparatus and a refrigerating apparatus. Moreover, the present invention is applicable to any other devices such as an air-sending device and a ventilation device, as well as the refrigeration-cycle apparatus.

REFERENCE SIGNS LIST 1 body 2 decorative panel 3 air outlet 4 wind-direction-adjusting vane 5 intake grille 6 turbo fan 7 drain pan 7a drain-pan wall 7b drain-water-collecting portion 7c heat-exchanger-mounting stand 8 drain-pan case-attaching portion 9 securing plate 10 attaching hole 11 antimicrobial-agent-containing case 12 arm 13 case-attaching portion 14 tab portion 15 case frame 16 case lid 17 hinge 18 rib 19 case hole 20 case latch 21 net 22 attaching space 23 cushion 24 antimicrobial agent 26 drain pump 100 indoor unit 110 indoor heat exchanger 200 outdoor unit 210 compressor 220 four-way valve 230 outdoor heat exchanger 240 expansion valve 300 gas-refrigerant pipe 400 liquid-refrigerant pipe

The invention claimed is:

1. An indoor unit comprising:

an air-sending device from which air is taken into a body;

a securing plate provided at an upper edge of a sidewall of a drain pan for collecting drain water generated from a heat exchanger through which the air blown by the air-sending device passes; and an antimicrobial-agent-containing case that contains an antimicrobial agent and includes a container portion positioned in an area where the drain water is collected, a case-attaching portion conforming to the securing plate and being detachably attached to the securing plate, and an arm connecting the container portion and the case-attaching portion, wherein:

the antimicrobial-agent-containing case is attachable to the securing plate from an opening of the drain pan facing the air-sending device;

the securing plate has an attaching hole;

an attaching space having a recessed shape is provided below the securing plate;

a tab portion is provided below the case-attaching portion of the antimicrobial-agent-containing case; and the antimicrobial-agent-containing case is fixed to the drain pan at a position where the tab portion which is inserted into the attaching hole is visible from the attaching space.

2. The indoor unit of claim 1, wherein at least a case frame serving as the container portion, a case lid, and a hinge connecting the case frame and the case lid of the antimicrobial-agent-containing case are formed as an integral body.

3. An air-conditioning apparatus configured to condition air, comprising:

the indoor unit of claim 1; and an outdoor unit.

* * * * *